US006292438B1

(12) United States Patent
Jones

(10) Patent No.: US 6,292,438 B1
(45) Date of Patent: Sep. 18, 2001

(54) GOLF BAG WITH TIMEPIECE

(75) Inventor: George Jones, Portland, OR (US)

(73) Assignee: Yoshida Group, Inc., Portland, OR (US)

( * ) Notice: Subject to any disclaimer, the term of this patent is extended or adjusted under 35 U.S.C. 154(b) by 0 days.

(21) Appl. No.: 09/416,207

(22) Filed: Oct. 8, 1999

(51) Int. Cl.[7] ..... G04B 47/00
(52) U.S. Cl. ..... 368/10
(58) Field of Search ..... 368/10, 276–282

(56) References Cited

U.S. PATENT DOCUMENTS

| | | | |
|---|---|---|---|
| D. 319,804 | 9/1991 | Johnson et al. | D11/221 |
| D. 367,427 | 2/1996 | Kogler | D10/2 |
| D. 368,036 | 3/1996 | Tronolone, Jr. | D10/2 |
| 1,871,898 | 8/1932 | Manheimer . | |
| 2,636,751 | 4/1953 | Carlson . | |
| 4,154,275 | 5/1979 | Cauley | 150/35 |
| 4,875,579 | 10/1989 | Tak | 206/315.1 |
| 5,244,220 | 9/1993 | Cortez | 280/47.26 |
| 5,357,487 | 10/1994 | Colemen, III | 368/10 |
| 5,894,271 * | 3/1999 | Cleveland et al. | 368/109 |

FOREIGN PATENT DOCUMENTS

| | | | |
|---|---|---|---|
| 0506007 * | 9/1992 | (EP) | 368/109 |

* cited by examiner

*Primary Examiner*—Bernard Roskoski
(74) *Attorney, Agent, or Firm*—Chernoff, Vilhauer, McClung & Stenzel, LLP

(57) ABSTRACT

A golf bag timepiece is incorporated into a golf bag for providing a readily accessible indication of time of day and the event time of a round of golf. The timepiece is held in a pocket attached to or integral with the golf bag. The pocket has a transparent cover and fits snugly over the face of the timepiece so that control buttons on the timepiece may be manipulated through the cover without removing the timepiece from the pocket.

8 Claims, 2 Drawing Sheets

GOLF BAG WITH TIMEPIECE

BACKGROUND OF THE INVENTION

The present invention relates to a timing device for use with a golf bag and more particularly to a golf bag having an integral timing device for keeping golfers abreast of both the time of day and the elapsed time during a round of golf.

The pace of play on golf courses is an issue of considerable importance to both the course owners and clubs and the golfing public. It is essential to good management of the game that play proceed at a prescribed rate. A round of golf should be played in four to four and one half hours. On busy days it is essential that players finish their rounds in no more than four and one half hours. This means that, on average, a hole should be completed every fifteen minutes.

Most golfers find watches a hindrance or a distraction and they frequently put them in their golf bags or pockets, out of the way and inaccessible. Thus, such golfers do not have a good way of monitoring their time on the course.

This leads on occasion to slow play but the group playing slow may have no idea that they are behind schedule.

In the past timepieces have been proposed which may be clipped to golf bags. These having taken various forms and are illustrated in the following U.S. Patents: Ohren, U.S. Pat. No. Des. 384,587; Johnson et al., U.S. Pat. No. Des. 319, 084; Tak, U.S. Pat. No. 4,875,579.

Various timing devices have also been proposed in order to maintain pace of play. For example, Coleman, U.S. Pat. No. 5,357,487, shows a timer having displays for elapsed time, the identification of the proper hole, and time of day.

The problem with the designs described above is that there is no convenient way to integrate the timer with a golf bag in a way that allows full use of the timer while keeping it impervious to the elements. Clocks that clip on to the bag in various ways become dangling pieces of hardware that fall off, are broken or get wet and cease to function.

SUMMARY OF THE INVENTION

The present invention provides a timing device that is removable yet integral to the golf bag. It provides a display of chronological time and event time. The timing device is a flat thin digital timepiece with control buttons set in slightly beveled edges of the housing of the timepiece. The timepiece fits snugly into a pocket in the golf bag that has a transparent window. The control buttons, which control the setting of the clock and event timer, stick out from the surface of the timepiece, and may be manipulated through the window of the pocket without removing the timepiece from the pocket. The timepiece is protected from rain while in the pocket and need be taken out only to change the battery.

DETAILED DESCRIPTION OF THE PREFERRED EMBODIMENT

Figure 1:
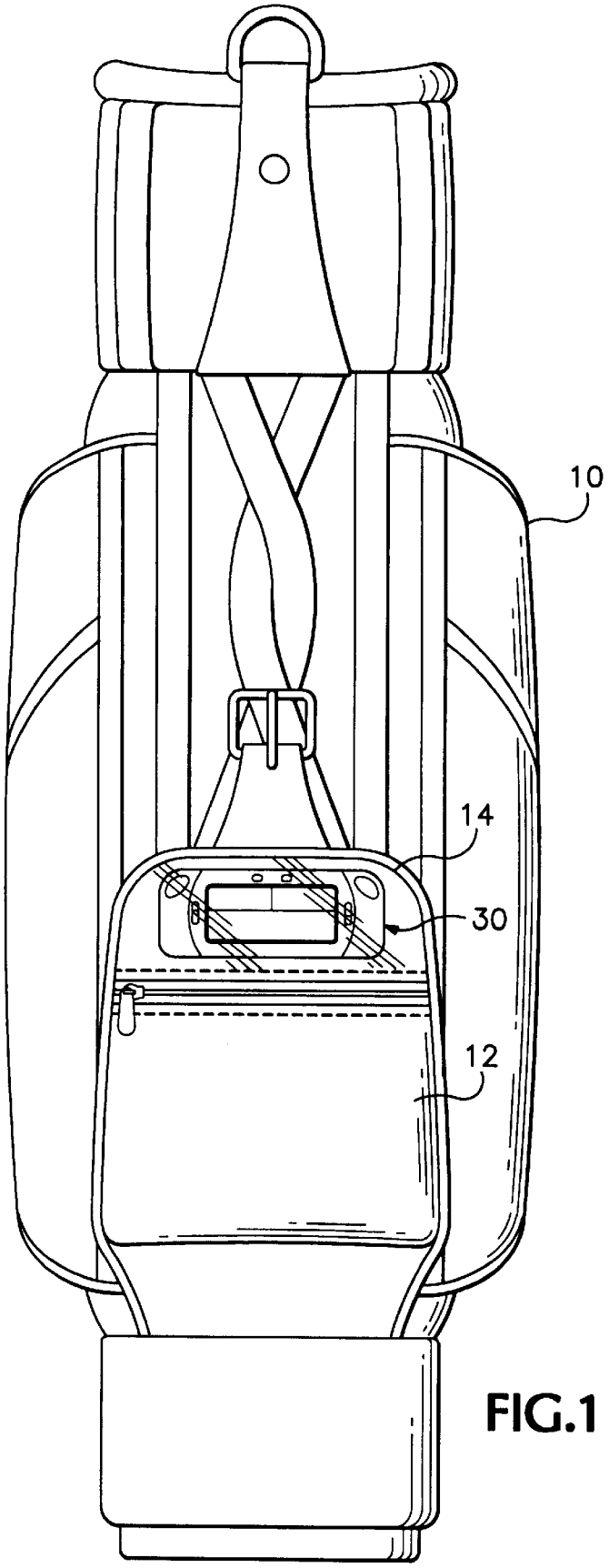
FIG. 1 is a front elevation view of the golf bag and timer of the invention.
Figure 3:
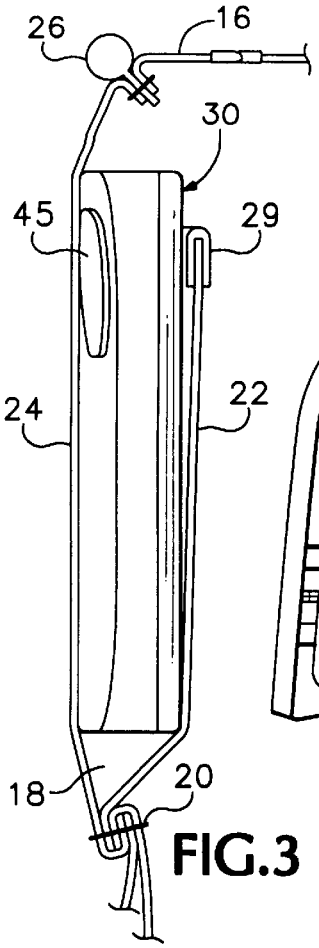
FIG. 3 is a cutaway view taken along line 3—3 of FIG. 2.
Figure 2:
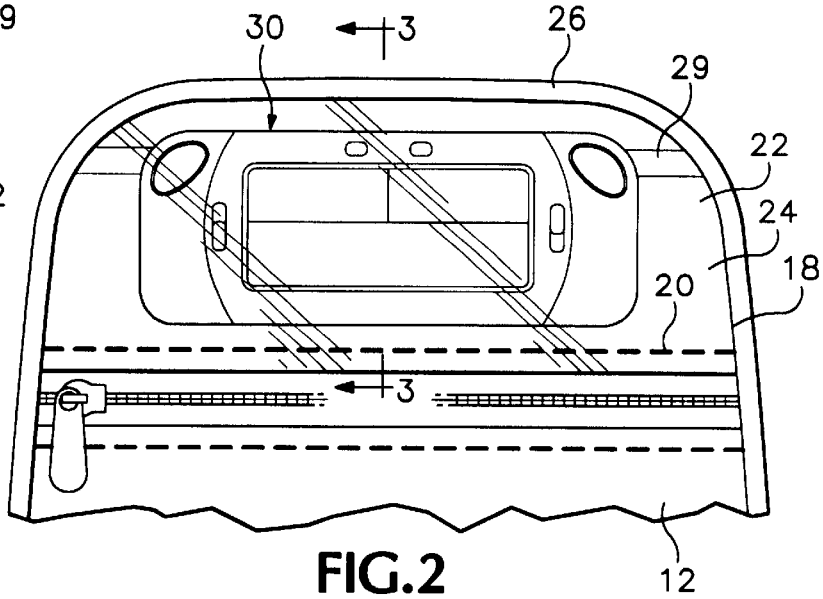
FIG. 2 is a view of the timer held within a pocket having a transparent cover.
Figure 4:
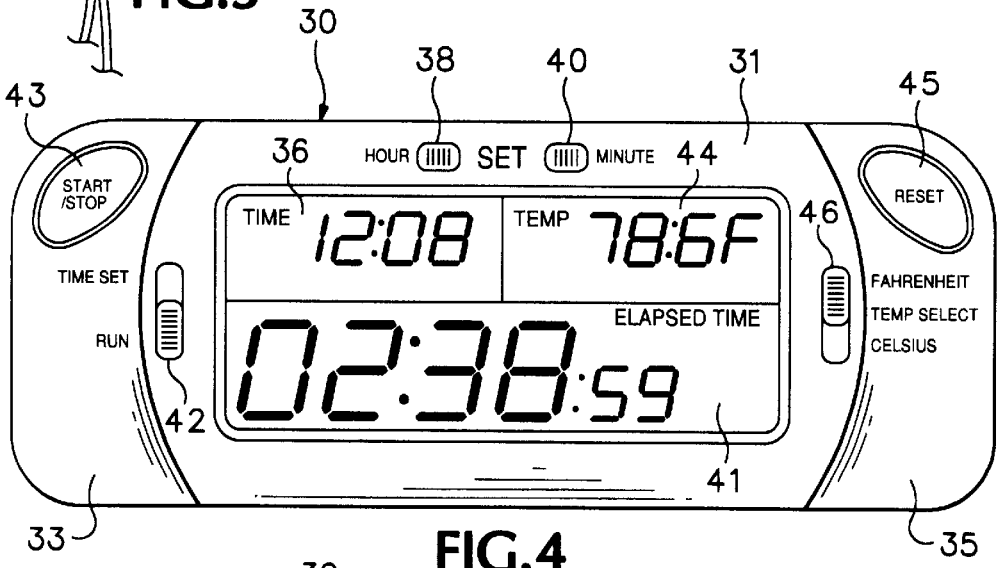
FIG. 4 is a front view of the timepiece of the invention.

Referring to FIG. 1, a golf bag 10 includes a ball pocket 12 that is accessed by a zipper 14. When unzipped the front of the pocket forms a flap 16. Inside the flap 16 is an interior pocket 18 formed by a stitch 20 between a transparent cover 24 and a piece of backing material 28 with a reinforced top 29. A seam 26 connects the flap 16 to the top of the transparent cover 24.

Figure 5:
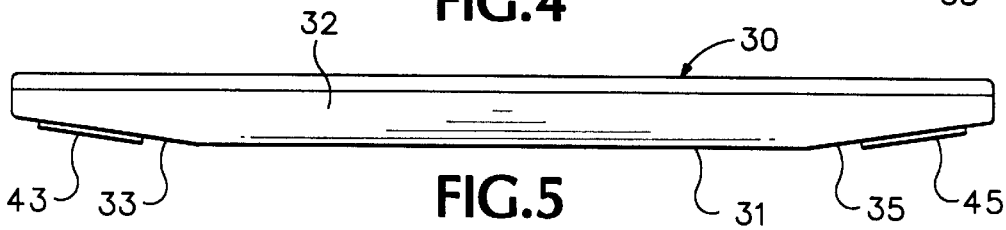
FIG. 5 is a top view of the timepiece of FIG. 4.

A timepiece 30 is snugly held within the pocket 18. The flap 16 extends over the pocket 18 so as to protect it from rain when the ball pocket 12 is opened. The pocket 18 is sized so that the transparent cover 24 stretches tightly across the face of the time piece 30. The timepiece 30 has a planar face 31 with slightly slanted portions 33 and 35 near the outside edges (refer to FIG. 5). Because the transparent cover 24 tends to pinch inwardly near the stitch 20 and the seam 26, the slanted portions 33,35 of the face 31 serve to insure that the cover 24 will lie flat across substantially the entire surface of the timepiece 32.

The timepiece 30 includes a digital time of day display 36. Hours and minutes indicators on the display 36 are set by switches 38 and 40. A mode switch 42 places the time of day feature in either a "run" or "time set" mode. In the "time set" mode, the switches 38 and 40 are operative.

The timepiece 30 also includes an elapsed time or event display 40. This display functions much like a stopwatch. It is controlled by two pushbutton switches located on opposite sides of the face 31. A start/stop pushbutton switch 43 starts the event display 40 when it is depressed a first time. The next time the switch 43 is depressed it will stop the event display 40. On the opposite side of the face 31 is a reset pushbutton switch 45. Depressing the switch 45 will reset the display 40 to zero.

The timepiece may also include a temperature gauge 44 which displays temperature in Fahrenheit or Celsius degrees. A selector switch 46 toggles between the two temperature scales. The temperature display is optional and may be replaced on the face 31 with a manufacturer's logo or the like.

The pushbutton switches 43 and 45 are oversized and slightly raised with respect to the slanted portions 33 and 35 from which they protrude. Because the cover 24 is stretched flat across portions 33 and 35, the pushbuttons 43 and 45 may be manipulated through the cover 24 and there is no need for the user to remove the timepiece from the pocket 18 for this purpose. Since the time of day display may also be set through the window, the timepiece 30 may be left in the pocket 18, functioning as an integral part of the bag. At the beginning of a round of golf, the player resets the event display 40 by simply depressing the pushbutton 45. He does this by pressing on the front of the cover 24. Similarly, if the event timer must be stopped during play, because of a rain delay or the like, the start/stop switch 43 may be manipulated by applying finger pressure on the pushbutton 43 through the cover 24. Similarly, the clock set switches 38 and 40, along with the mode switch 42, may be manipulated by pressure applied to the front of the transparent cover 24.

The invention has been shown in its preferred embodiment as being integral to a golf bag, but there are other ways of combining the timepiece with the golf bag. For example a belt having a pouch for holding the timepiece could be provided. The belt would wrap around the top of the bag and could support a pouch having a zipper. Inside the pouch would be a pocket similar to the pocket illustrated in the drawings that would hold the timepiece.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In combination, a golf bag and a timepiece, the golf bag comprising an elongate hollow container of substantially cylindrical shape and having an open end and a closed end, and including a display pocket having a back portion and a front portion, the front portion including a transparent cover, an electronic timepiece fitted inside the display pocket, the timepiece having a display visible through the transparent cover, the display having provision for displaying at least a chronological time of day and wherein the timepiece includes a thin elongate body having a front face and a pair of angled end faces, a first one of said pair of angled of angled end faces having a first switch positioned thereon, and a second one of said pair of angled end faces having a second switch positioned thereon.

2. The combination of claim 1 wherein the display further includes an event timer, the first switch manually operable through the transparent cover, the first switch being operable to reset the event timer.

3. The combination of claim 1 wherein the display pocket includes an overhanging flap making the pocket substantially impervious to rain.

4. The combination of claim 2 wherein the second switch manually operates through the front cover to start and stop the event timer such that a first actuation of the second switch starts the event timer and a second actuation of the second switch stops the event timer.

5. The combination of claim 1 wherein the golf bag includes a storage pocket having a front facing portion, and wherein said display pocket is situated in said front facing portion.

6. The combination of claim 1 wherein said timepiece further includes a temperature display.

7. The combination of claim 1 wherein the display pocket is integral with the golf bag.

8. The combination of claim 1 wherein the display pocket is contained within a pouch affixed to the golf bag.

* * * * *